US005967747A

United States Patent [19]

Burke et al.

[11] Patent Number: 5,967,747

[45] Date of Patent: Oct. 19, 1999

[54] LOW NOISE FAN

[75] Inventors: Steven A. Burke, Champlin; Michael T. Basham, Maple Grove; Robert A. Geyer, Champlin; Laurence A. Jensen, Oakdale, all of Minn.

[73] Assignee: Tennant Company, Minneapolis, Minn.

[21] Appl. No.: 09/009,804

[22] Filed: Jan. 20, 1998

[51] Int. Cl.[6] ..... F01D 1/02; F03B 1/04

[52] U.S. Cl. ..... 415/206; 415/208.1

[58] Field of Search ..... 415/6, 206, 208.1, 415/196, 197, 211.1, 226, 169.2

[56] References Cited

U.S. PATENT DOCUMENTS

| | | | |
|---|---|---|---|
| 1,845,152 | 2/1932 | Hutchinson . | |
| 2,264,071 | 11/1941 | Dibovsky | 415/206 |
| 2,805,615 | 9/1957 | Rudy | 415/226 X |
| 2,987,983 | 6/1961 | Solzman | 415/226 X |
| 3,040,646 | 6/1962 | Jueng et al. | 415/226 X |
| 3,045,579 | 7/1962 | Jenn et al. | 415/226 X |
| 3,272,137 | 9/1966 | Maitlen et al. . | |
| 3,489,340 | 1/1970 | Holzhausen . | |
| 3,583,826 | 6/1971 | Schonwald . | |
| 3,829,250 | 8/1974 | Samson, Jr. . | |
| 4,082,478 | 4/1978 | Schmitz | 415/206 X |
| 4,448,573 | 5/1984 | Franz . | |
| 5,161,939 | 11/1992 | Stadler . | |

FOREIGN PATENT DOCUMENTS

| | | | |
|---|---|---|---|
| 2017947 | 12/1977 | Germany | 415/206 |
| 2853702 | 7/1980 | Germany | 415/206 |

*Primary Examiner*—John Ryznic

*Attorney, Agent, or Firm*—Dorn, McEachran, Jambor & Keating

[57] ABSTRACT

A collectorless vacuum fan for floor maintenance machines has a backplate with an inlet plate attached thereto in spaced relationship, and an impeller between the backplate and inlet plate. Both the backplate and the inlet plate extend radially beyond the periphery of the impeller. A shaft mounts the impeller for rotation. The inlet plate has a central opening providing air to the hub of the impeller. Vanes on the impeller discharge air out through a diffuser channel defined by the space between the inlet plate and the backplate outside the periphery of the impeller. Attachment elements for mounting the inlet plate on the backplate leave the diffuser channel substantially unobstructed so that air is discharged about the entire periphery of the impeller. The fan has increased air flow compared to a conventional fan having an integral collector housing and decreased noise compared to a fan having a 360 degree discharge and no diffuser.

9 Claims, 3 Drawing Sheets

Fig. 2.
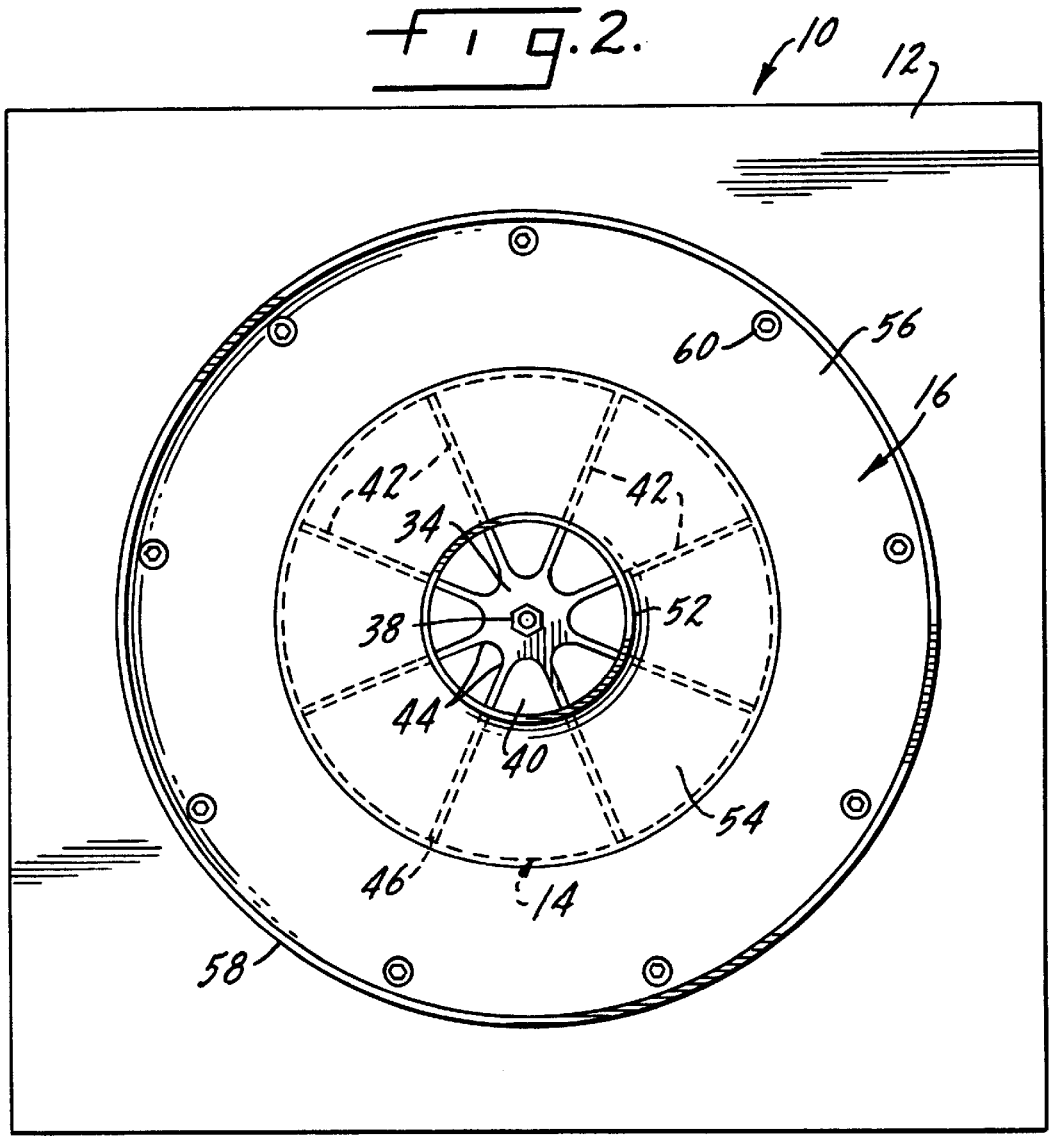
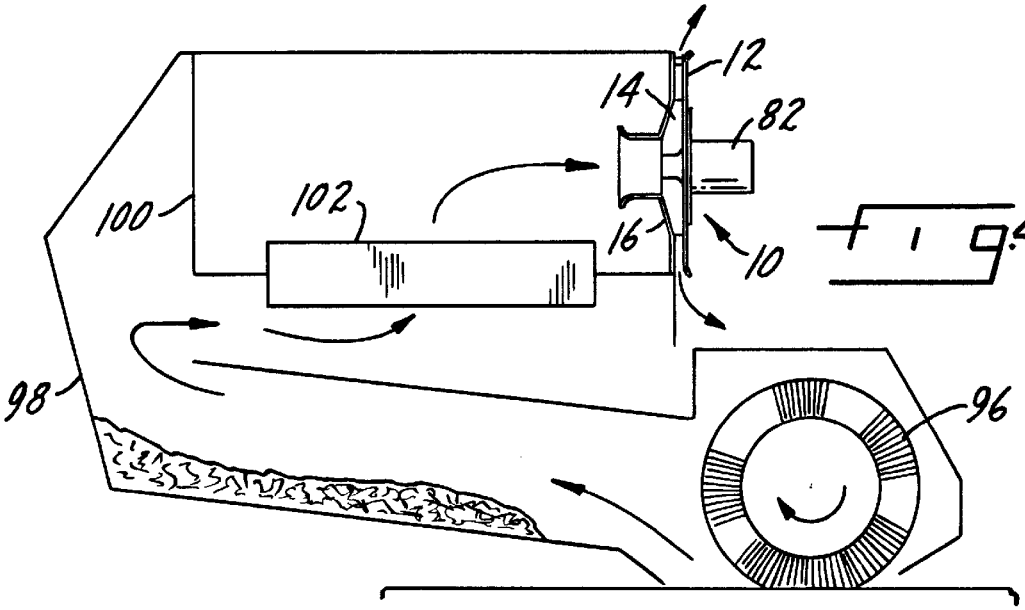
Fig. 4.

66
68
64
70
94
92
86
72
82
90
10
12
16
88
78
84
74
76
80

LOW NOISE FAN

BACKGROUND OF THE INVENTION

Commercial and industrial floor maintenance machines such as sweepers and scrubbers incorporate a vacuum system for dust control or for removing liquids such as cleaning solutions from a floor being cleaned. The vacuum system typically includes a radial flow fan having an impeller driven by a motor for creating the vacuum. In a conventional fan the impeller is enclosed within a housing. The housing includes a collector, often of volute shape, around the periphery of the impeller which gathers the exhaust air from the impeller and directs it out through one or more openings in the collector. A diffusion channel may also be provided in the housing, spaced radially between the periphery of the impeller and the collector. While this arrangement performs the desired function, the need for a specially-formed housing incorporating the collector increases the cost of the unit, and use of a collector reduces the airflow for a given power input. Low cost fans have been used that have neither a collector nor a diffuser. While this approach saves on housing costs, it has the disadvantages of lower air flow and higher noise.

SUMMARY OF THE INVENTION

The present invention is directed to a radial flow vacuum fan which allows a significantly higher volume of air to pass through the fan, with low noise and low cost. This is achieved with a fan having a diffuser channel but no collector. Thus, air is discharged about the entire periphery of the impeller. The diffuser channel minimizes fan noise but does not require the expensive, specially-designed housing that a collector requires. Additionally, in many cases the inlet plate forming part of the diffuser channel can be formed into part of a wall of a filter box or the like on which the fan may be mounted, resulting in even lower cost through fewer parts.

The fan itself has a backplate which mounts a motor, the rotatable shaft of which projects through a clearance hole in the backplate, and is generally normal to the backplate. An impeller is mounted on the shaft adjacent the backplate and is rotated by the motor. The impeller includes a central hub engageable with the shaft and a plurality of vanes extending generally radially. An inlet plate is connected to the backplate by attachment elements comprising spacers located well beyond the outer periphery of the impeller so as not to cause air turbulence. The impeller is located between the backplate and inlet plate. The inlet plate has an air inlet opening opposite the hub of the impeller. An air inlet tube is attached to the inlet plate and surrounds the opening for directing incoming air into the impeller. A portion of the inlet plate has a profile matching that of the vanes and is closely spaced to the vanes. A diffuser channel is defined between the inlet plate and the backplate and radially outside the periphery of the impeller. The spacers, inlet plate and backplate leave substantially all of the diffuser channel unobstructed to air flow radially out of the impeller. This permits air to be discharged to ambient about the entire periphery of the impeller.

BRIEF DESCRIPTION OF THE DRAWINGS

FIG. 2 is a view of the fan, looking in the direction of line 2—2 of FIG. 1.

FIG. 4 is a diagrammatic side elevation view of a floor sweeping machine with the vacuum fan of the present invention incorporated in the filter box.

DETAILED DESCRIPTION OF THE INVENTION

Figure 1:
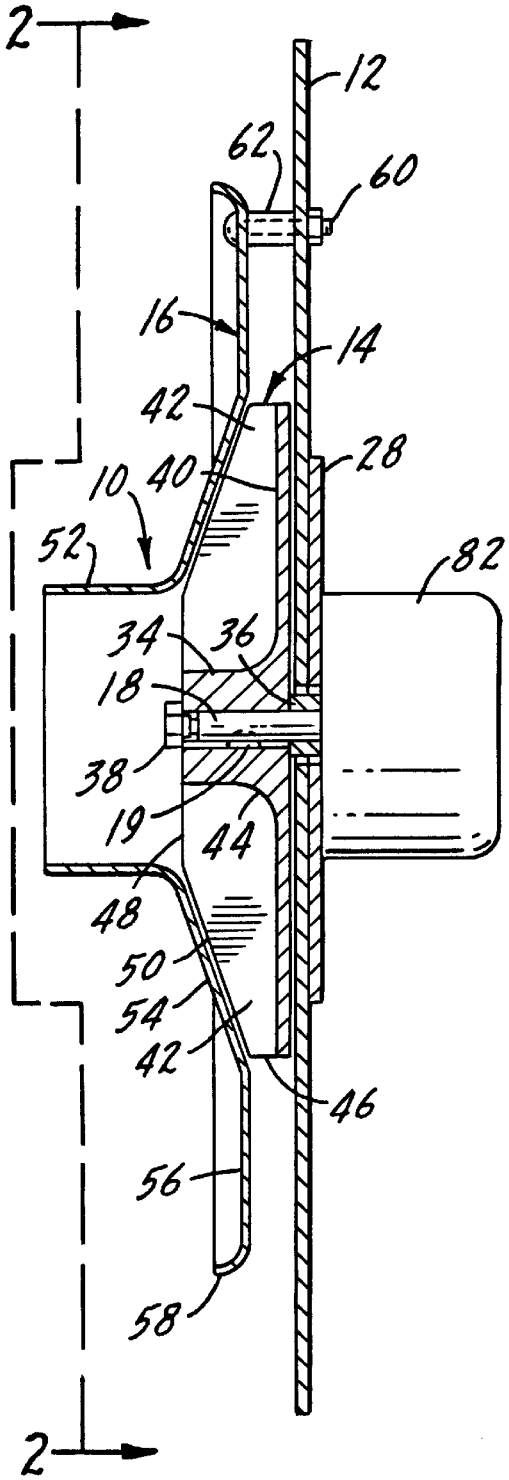
FIG. 1 is a section through the vacuum fan of the present invention.

The vacuum fan of the present invention is shown generally at 10 in FIGS. 1 and 2. The main parts of the fan are a backplate 12, an impeller 14 and an inlet plate 16. Each of these will now be described.

The backplate 12 is seen to be a simple flat plate. FIG. 2 shows it as square, but it could be round or some other shape. The backplate mounts a motor 82, the rotatable shaft 18 of which extends perpendicularly to the backplate through an opening therein. A stiffener plate 28 may be used if needed.

The impeller 14 has a central hub 34 with a bore therethrough for receiving the shaft 18. A key 19 locks the impeller to the shaft. The hub 34 abuts against a spacer 36 which in turns rests against a shoulder on the shaft. A nut 38 retains the impeller on the shaft. A circular disc 40 adjoins the hub 34 at an appropriate fillet as shown. A plurality of vanes 42 extend generally radially from a root 44 at the hub to tips 46 at the free ends of the vanes. One edge of the vanes is attached to the disc 40. The other edge defines a profile having a straight portion 48 near the root 44 and a tapered portion 50 toward the tip 46. While the vanes shown are straight, as seen in FIG. 2, they could be curved. Also, the tapered portion 50, as seen in FIG. 1, may be curved rather than straight.

The inlet plate 16 has a cylindrical inlet tube 52 which is concentric with the hub 34 and shaft 18. The wall of the tube is about as far from the center of shaft 18 as the straight portions 48 of the vanes 42. The inlet tube directs incoming air to the impeller 14. An inner section 54 of the inlet plate conforms to the profile of the vanes, in this case to the profile of the tapered portion 50 of the vanes. The plate is closely spaced to the impeller. By "closely spaced" it is preferred that the inlet plate be as close as feasible without contacting the impeller. A clearance on the order of 0.020 inches has been found to be feasible. Increasing the clearance between the inner section 54 and the impeller adversely affects the amount of vacuum pulled by the fan.

Beyond the circumference of the impeller disc 40 the inlet plate has an outer section 56 which is parallel to the backplate 12 until it terminates at an upturned flange 58. This flange is optional, but it stiffens the inlet plate and improves the airflow out of the fan. Attachment elements in the form of bolts 60 and spacers 62 connect the outer section 56 of the inlet plate to the backplate 12. The spacers 62 are relatively small compared to the discharge area and are sufficiently far from the impeller that they do not measurably impede air flow out of the fan. The outer section 56 of the inlet plate and the facing portion of the backplate 12 define a diffuser. Air discharged by the vanes of the rotating impeller flows outward through the channel formed by the diffuser throughout the full 360 degree circumference of the impeller, with the velocity of the air reducing as it flows outward. Because of this velocity reduction the diffuser has been found to reduce the noise associated with the fan when compared to other fans having a 360 degree discharge and no diffuser. Satisfactory results have been obtained with an inlet plate having an outside diameter which is about 160% of the impeller diameter.

In the past vacuum fans have typically included a collector around the periphery of the impeller. The collector is typically an enclosed circular or volute channel attached to the backplate and the inlet plate and open to the impeller. It collects air discharged by the impeller and directs it to an outlet, which typically is arranged tangentially to the collector. In the present invention it has been found that significant cost savings can be achieved by not using a collector. By combining the tapered impeller, diffuser channel and collectorless fan concepts, the present invention provides high air flow with low noise and low cost. Efficiency, defined as air HP/shaft HP, was found to be greater in a fan made according to the present invention than in either of two fans, one with a collector only and the other with a collector and a diffuser, that were used in comparative tests, thus delivering more air for the same power. The collectorless fan also maintains nearly constant inlet vacuum levels over a wide range of airflow.

Figure 3:
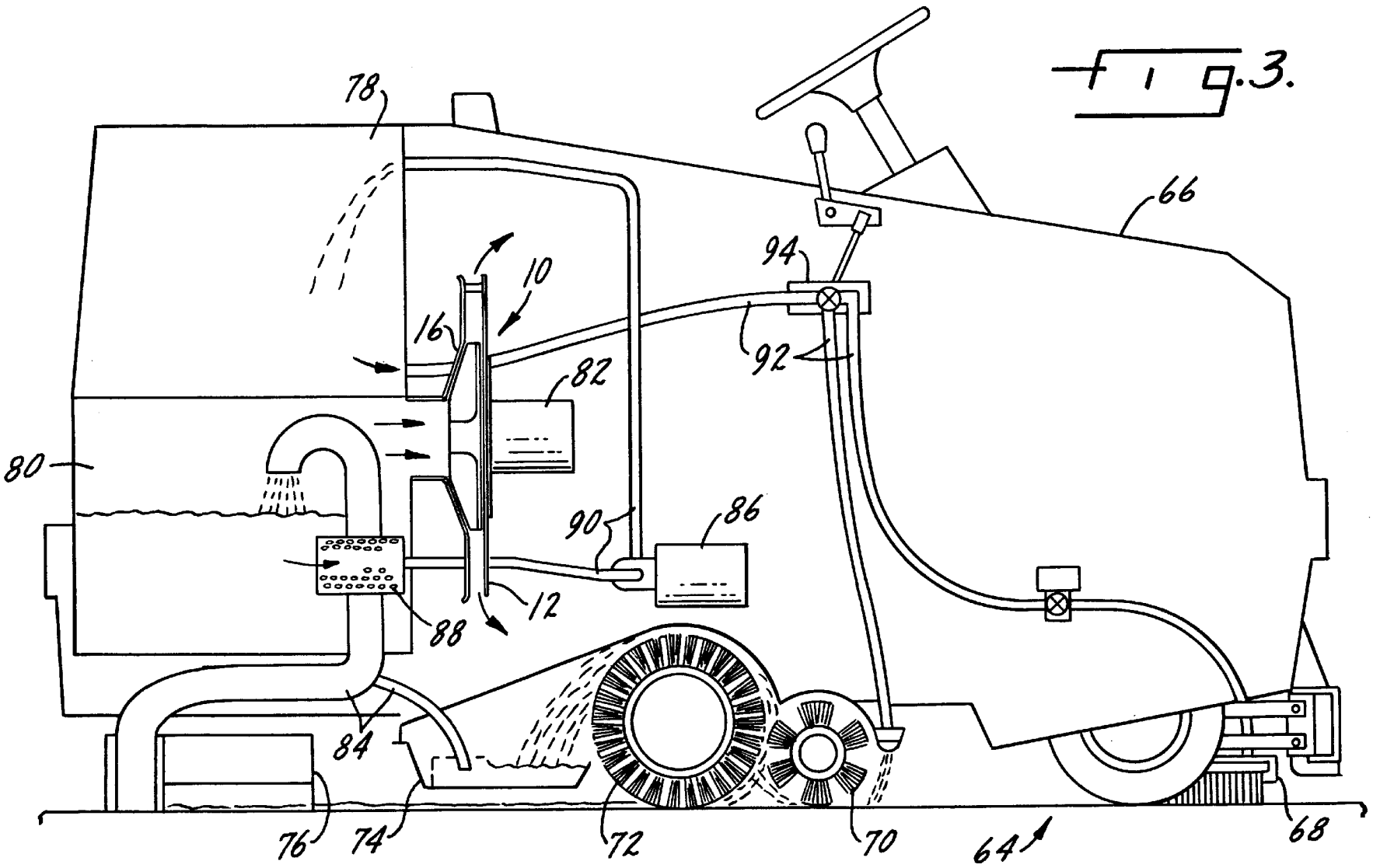
FIG. 3 is a diagrammatic side elevation view of a floor scrubbing machine with the vacuum fan of the present invention installed therein.

FIG. 3 shows a typical application of the vacuum fan to a floor scrubber shown schematically at 64. Generally, the scrubber includes a body 66, an edge brush 68, main scrub brushes 70, 72, a solution recovery pan 74, a squeegee 76, a fresh cleaning solution tank 78 and a spent solution tank 80. The vacuum fan 10 has its inlet plate attached to the spent solution tank 80. The motor for the fan 10 can be seen at 82.

The fan 10 vacuums spent cleaning solution from the pan 74 and squeegee 76 through return conduits 84 into the tank 80. A filter 88 removes dirt and sediment from the cleaning solution and pump 86 recycles it to the tank 78 through conduit 90. Fresh cleaning solution is supplied to the brushes through lines 92 under the control of valve 94.

Application of the collectorless fan to a sweeper is shown in FIG. 4. Here the sweeper brush 96 propels debris into the hopper 98. A filter box 100 has a dust filter 102 built into its bottom wall. The vacuum fan 10 is built into the filter box, with the inlet plate 16 serving as part of a side wall thereof.

Figure 5:
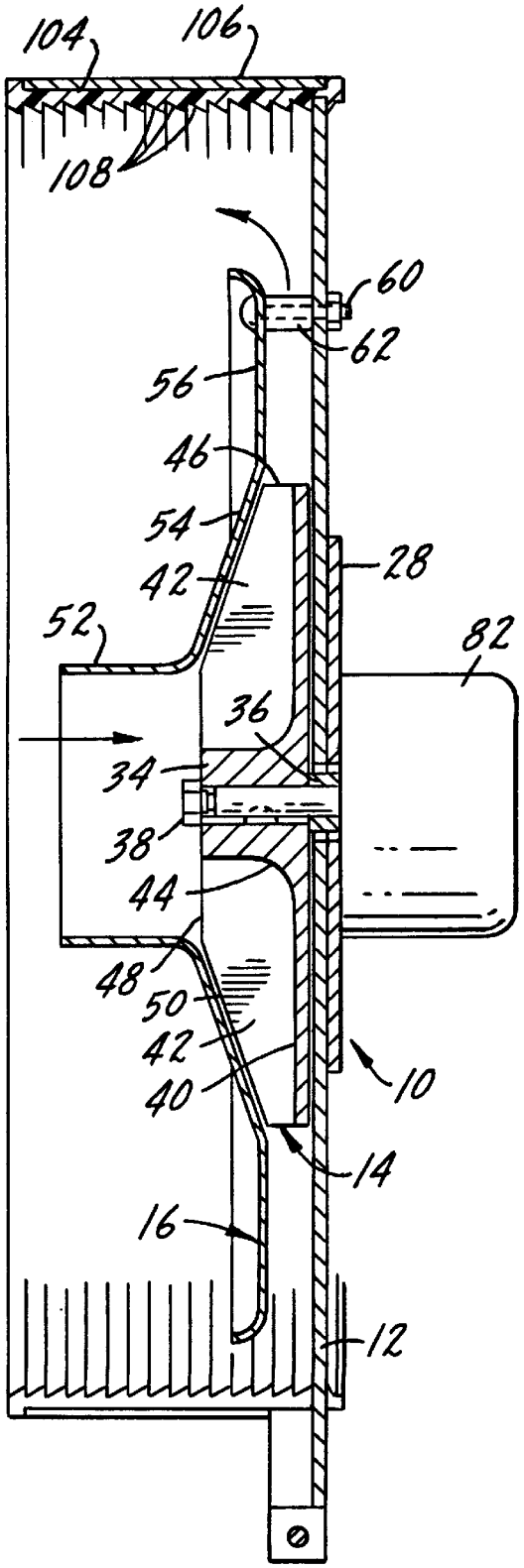
FIG. 5 is a view similar to FIG. 1, showing an alternate embodiment including a moisture collection ring.

FIG. 5 shows a modification of the invention when used on a scrubber. The air moved by the blower contains water and to prevent moisture from reaching the blower a grooved ring 104 surrounds the blower and is held in place by a clamp 106. The ring 104 forces the air leaving the fan to turn a corner and centrifugal force slings the moisture against the ring 104. Ring 104 has a series of parallel grooves 108 which are raked toward backplate 12. Moisture will collect in the valleys of the grooves, between the separating ribs, and will run down by gravity to the bottom of the blower where it may drip off at an opening in the plastic ring 104. It is important that the grooves 108 be asymmetrical as otherwise the airflow may blow the water out of the grooves.

While a preferred form of the invention has been shown and described, it will be realized that alterations and modifications may be made thereto without departing from the scope of the following claims.

I claim:

1. A collectorless fan for creating a vacuum in a floor maintenance machine, comprising:

a backplate;

a rotatable shaft extending through a clearance hole in the backplate and generally perpendicularly thereto, drive means attached to the shaft for rotating it;

an impeller mounted on the shaft adjacent the backplate and rotated by the drive means, the impeller including a central hub engageable with the shaft and a plurality of generally radial vanes;

an inlet plate connected in spaced relationship to the backplate with the impeller being between the backplate and inlet plate, the inlet plate and the backplate extending radially beyond the outer periphery of the impeller, the inlet plate having an air inlet opening opposite the hub of the impeller, the inlet plate comprising a first, inner section closely spaced from the vanes and having generally the same profile as the vanes, and a second, outer section that extends beyond the vanes to direct air flow induced by impeller rotation to a diffuser channel defined by a space between the inlet plate and the backplate radially beyond the outer periphery of the impeller; and attachment means for connecting the inlet plate to the backplate, the attachment means, inlet plate and backplate leaving substantially all of the diffuser channel unobstructed to air flow radially out of the impeller such that air is discharged radially to ambient substantially about the entire periphery of the impeller.

2. The fan of claim 1 further comprising an air inlet tube attached to the inlet plate and surrounding said opening for directing incoming air into the impeller.

3. The fan of claim 1 wherein the attachment elements comprise a plurality of spacers which are individually and collectively small compared to the total area of the diffuser channel.

4. The fan of claim 1 wherein the inlet plate has a diameter that is about 160% of the impeller diameter and the backplate extends radially beyond the inlet plate.

5. The fan of claim 1 including a moisture collection ring fastened to the backplate and extending circumferentially around at least a portion of the inlet plate.

6. The fan of claim 5 wherein the collection ring has a plurality of grooves facing the impeller.

7. The fan of claim 6 wherein the grooves are generally parallel and asymmetrical in cross section.

8. The fan of claim 1 in which the drive means is a motor supported by the backplate.

9. A fan for creating a vacuum in a floor maintenance machine, comprising:

a backplate;

a motor supported by the backplate, the motor having a rotatable shaft extending through a clearance hole in the backplate and generally perpendicularly thereto;

an impeller mounted on the shaft adjacent the backplate and rotated by the motor, the impeller including a central hub engageable with the shaft and a plurality of generally radial vanes;

an inlet plate connected in spaced relationship to the backplate with the impeller being between the backplate and inlet plate, the inlet plate having an air inlet opening opposite the impeller and at least a portion of the inlet plate being spaced from the vanes to direct air flow induced by impeller rotation to a diffuser channel defined by the space between the inlet plate and the backplate radially beyond the outer periphery of the impeller;

attachment means for connecting the inlet plate to the backplate, the attachment means, inlet plate and backplate leaving substantially all of the diffuser channel unobstructed to air flow radially out of the impeller such that air is discharged to ambient substantially about the entire periphery of the impeller, and a moisture collection ring attached at the periphery of the backplate, said collection ring extending circumferentially at least in part about the inlet plate and having a plurality of grooves facing the impeller.

* * * * *